US005499088A

United States Patent [19]

Menjo

[11] Patent Number: 5,499,088

[45] Date of Patent: Mar. 12, 1996

[54] COLOR TONER IMAGE FIXING APPARATUS HAVING A BACK-UP MEMBER, HEATER AND FILM WITH A DEFORMABLE SURFACE LAYER

[75] Inventor: Takeshi Menjo, Tokyo, Japan

[73] Assignee: Canon Kabushiki Kaisha, Tokyo, Japan

[21] Appl. No.: 305,803

[22] Filed: Sep. 13, 1994

Related U.S. Application Data

[63] Continuation of Ser. No. 824,585, Jan. 23, 1992, abandoned.

[30] Foreign Application Priority Data

Jan. 25, 1991 [JP] Japan ..... 3-025401
May 7, 1991 [JP] Japan ..... 3-101380

[51] Int. Cl.[6] ..... G03G 15/20

[52] U.S. Cl. ..... 355/285; 219/216

[58] Field of Search ..... 355/208, 282, 355/285, 289, 290; 219/492, 495, 216, 469

[56] References Cited

U.S. PATENT DOCUMENTS

| | | | |
|---|---|---|---|
| 3,578,797 | 5/1971 | Hodges et al. | 219/388 X |
| 4,348,102 | 9/1982 | Sessink | 219/216 X |
| 4,563,073 | 1/1986 | Reynolds | 219/216 X |
| 4,565,439 | 1/1986 | Reynolds | 219/216 X |
| 4,582,416 | 4/1986 | Karz et al. | 355/290 |
| 4,737,818 | 4/1988 | Tanaka et al. | 219/216 |
| 5,051,784 | 9/1991 | Yamamoto et al. | 355/285 |
| 5,124,756 | 6/1992 | Stelter | 355/290 |
| 5,247,336 | 9/1993 | Mills, III | 355/285 |

FOREIGN PATENT DOCUMENTS

| | | | |
|---|---|---|---|
| 51-29825 | 3/1976 | Japan . | |
| 85464 | 5/1983 | Japan . | |
| 63-313182 | 12/1988 | Japan . | |
| 2-162383 | 6/1990 | Japan | 355/285 |
| 275481 | 11/1990 | Japan . | |

*Primary Examiner*—Benjamin R. Fuller
*Assistant Examiner*—John E. Barlow, Jr.
*Attorney, Agent, or Firm*—Fitzpatrick, Cella, Harper & Scinto

[57] ABSTRACT

A heating and color-mixing apparatus includes a heater; a film movable together with a recording material supporting a multi-layered unfixed toner image; a pressing member cooperative with the film to form a nip therebetween; the recording material being passed through the nip with its toner image contacted to the film, so that different color toners of the toner image are mixed by heat from the heater and pressure applied by the nip; wherein at least a recording material side of the film is composed of a silicone rubber.

18 Claims, 5 Drawing Sheets

COLOR TONER IMAGE FIXING APPARATUS HAVING A BACK-UP MEMBER, HEATER AND FILM WITH A DEFORMABLE SURFACE LAYER

This application is a continuation of application Ser. No. 07/824,585 filed Jan. 23, 1992 now abandoned.

FIELD OF THE INVENTION AND RELATED ART

The present invention relates to a heating and color-mixing apparatus having a heater, a film and a back-up or pressing member for mixing a toner image including laminated toners having different colors.

In a widely used image heating and fixing apparatus, a recording material is passed through a nip formed between a heating roller maintained at a predetermined temperature and a pressing roller having an elastic layer and urged to the pressing roller (heat roller type). However, such heating roller type apparatus have a drawback in that there is a waiting period until the predetermined temperature of the heating roller is reached, and in that the power consumption is large.

U.S. Pat. No. 3,578,797 and Japanese Patent Application Publication No. 29825/1976 each disclose an apparatus in which the toner image is heated and fused through an endless belt. Japanese Laid-Open Patent Applications Nos. 313182/1988, 153602–153610/1991 which have been assigned to the assignee of this application have proposed a film heating type fixing apparatus comprising an instantaneously responsive heater having a low thermal capacity and a thin film, by which the waiting period is eliminated or remarkably reduced. The surface of the film is constituted by a fluorine resin having a good parting agent such as PTFE, PFA or the like. However, the laminated toner images are subjected to color mixture by the heat and pressure in the film heating type, and toner offset easily occurs toward the film. The reasons for this are as follows. Generally, the color toner has a low softening point and has a sharp melting property. The color toner exhibits a lower viscosity than the black toner frequently used for monochromatic image formation, at the same temperature. Therefore, color mixture of the color toners is good to provide sufficient coloring and glossiness. However, the color toner has poor parting property, and therefore, the color toner is more easily offset than the black toner to the surface of a film having a surface temperature characteristic of PTFE, PFA or the like of the heat resistive fixing film.

In order to prevent elongation of the film, it requires high hardness, and therefore, the surface hardness is large.

In a fixing apparatus in which use is made of a film and a heater for generating heat toward the nip, the temperature at the contact surface relative to the toner is not completely controlled, and the toner heating temperature varies more, as compared with the heating roller type.

In the case of a monochromatic print, the temperature region in which toner offset occurs is large, and therefore, the problem is not significant. However, in the case of full-color image fixing in which different color toners are mixed and fixed, the temperature range in which toner offset does not occur is narrow.

SUMMARY OF THE INVENTION

Accordingly, it is a principal object of the present invention to provide a heat and color-mixing apparatus using a film and showing satisfactory surface properties such as a parting property.

It is another object of the present invention to provide a heating and color-mixing apparatus having a film with low surface hardness.

It is a further object of the present invention to provide a heating and color-mixing apparatus in which the thermal quantity applied to the laminated toner is stabilized.

It is a further object of the present invention to provide a heating and color-mixing apparatus in which at least such a surface of the film near the recording material is made of silicone rubber.

It is a further object of the present invention to provide a heating and color-mixing apparatus in which a pressing member press-contacted to the film is provided therein with heating means to maintain predetermined temperatures for the heater and the pressing rotatable member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
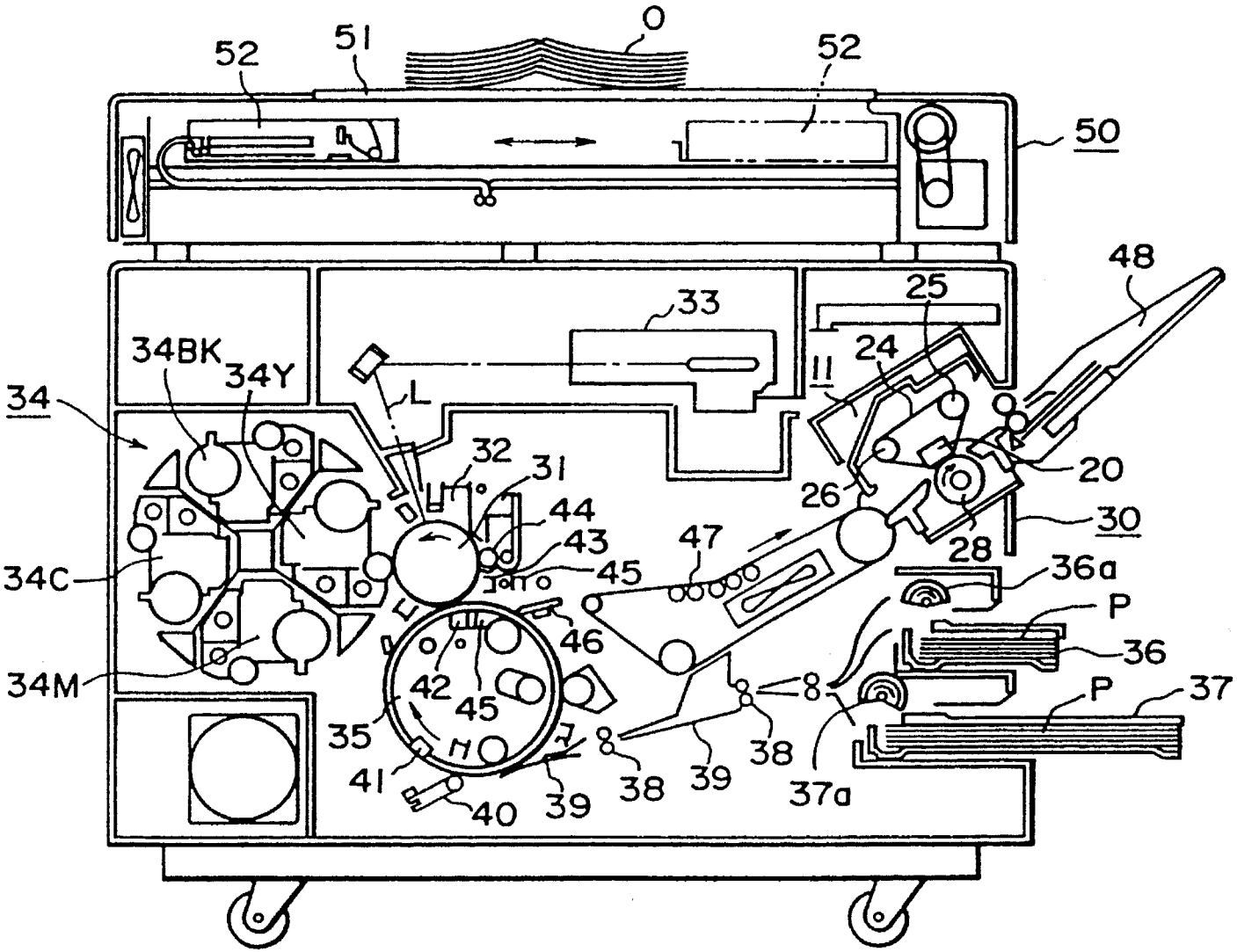
FIG. 1 is a sectional view of a full-color image forming apparatus incorporating a heating and color-mixing apparatus according to an embodiment of the present invention.

Referring to FIG. 1, there is shown a full-color image forming apparatus in cross-section incorporating a heating and color-mixing apparatus according to an embodiment of the present invention. The image forming apparatus comprises a main assembly 30, and a photoelectric original reader (scanner) 50 thereon. The reader 50 reads the color component pattern of the original O placed on an original supporting platen glass 51 by photoelectric reading unit 52 with one or more scanning operations. Then, the resultant yellow image signal, magenta image signal, cyan image signal and black image signal corresponding to the original O are supplied to an control circuit (not shown).

The main assembly 30 of the image forming apparatus comprises an image bearing member 31 in the form of an electrophotographic photosensitive drum (drum) which is rotated at a predetermined peripheral speed (process speed) in a direction indicated by an arrow (counterclockwise direction). A primary charger 32 uniformly charges the drum 31 to a predetermined polarity. A laser beam scanner 33 produces a laser beam L modulated in accordance with image signals supplied from the control circuit to scan the charged surface of the drum 31, by which an electrostatic latent image is formed on the photosensitive drum 31, corresponding to the image signals.

A rotary type developing apparatus 34 comprises four color developing devices, i.e., a yellow developing device 34Y, a magenta developing device 34M, a cyan developing device 34C and a black developing device 34BK. In response to switching signals, the developing devices are sequentially presented to the operating position relative to the drum 31. The latent image formed on the drum 31 is developed with the toner in the developing device at the operating position. A transfer drum 35 is rotated in the same direction as and at the same peripheral speed as the photosensitive drum 31. Sheets of recording material in the form of transfer material P are fed one by one to the transfer drum 35 out of first or second sheet feeding cassettes 36 or 37 by sheet feeding roller **36*a* or 37*a* and by feeding rollers 38 along a guide 39. The leading edge of the transfer material is gripped by a gripper 41 with the aid of a transfer material contacting roller 40 of the transfer drum 35, so that the transfer material is held on or wrapped around the outer peripheral surface of the transfer drum 35. The toner image on the photosensitive drum 31 is transferred onto the surface of the wrapped transfer material by a transfer charger 42. The transfer material wrapped on the transfer drum 35 repeatedly receives the toner images. Designated by reference numerals 43 and 44 are a discharger for electrically discharging the surface of the drum 1 after the image transfer, and a cleaning device for cleaning the surface of the drum 1**.

For the full-color image formation, the sequential operations are as follows:

(1) Charging; image exposure in response to yellow image signal; development by yellow developing device 34Y; image transfer; discharging; and cleaning:

(2) Charging; image exposure in response to magenta image signal; development by magenta developing device 34M; image transfer; discharging; and cleaning:

(3) Charging; image exposure in response to cyan image signal; development by cyan developing device 34C; image transfer; discharging; and cleaning: and (4) Charging; image exposure in response to black image signal; development by black developing device 34BK; image transfer; discharging; and cleaning.

Operations (1)–(4) are sequentially carried out, so that the yellow toner image, magenta toner image, cyan toner image and black toner image are sequentially transferred onto the same transfer material carried on the transfer drum 35, so that a combined (full-color) image is formed on the surface of the transfer material.

When the image transfer of the final black toner image is started, the leading edge of the transfer material is released from the gripper 41, and the transfer material is separated from the transfer drum 35 with the aid of a discharging separation charger 45 and separation pawls 46 and is conveyed on a conveyer belt 47 to an image fixing apparatus 11 where the images are fixed. Then, the transfer material is discharged to the discharge tray 48.

Description now will be made as to the powdery toner used in this embodiment. In a color image or full-color image formation, a sharp melting toner is used so as to expand the color-reproduceable range and so as to provide a color copy faithfully reproducing the original full-color image.

The toner is produced by fusing, kneading, pulverizing and classifying a mixture of binder resin material such as polyester resin or styrene-acrylic ester resin material or the like, coloring agent (dye, sublimating dye) and electrification control agent. As desired, the toner powdery may contain various materials such as hydrophobic colloidal silica.

From the standpoint of the fixing characteristics and the sharp melting characteristics, the color toner preferably uses a polyester resin material as a binder resin material. The sharp melting polyester resin includes for example a high polymer having an ester linkage in the principal chain of molecules synthesized from a diol compound and dicarboxylic acid.

In view of sharp melting characteristics, particularly preferred resins may be polyester resins obtained through polycondensation of at least a diol component selected from bisphenol derivatives represented by the formula:

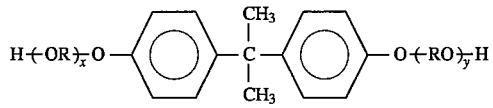

wherein R denotes an ethylene or propylene group; x and y are respectively a positive integer of 1 or more providing the sum (x+y) of 2 to 10 on an average and their substitution derivatives, and a two- or more-functioned carboxylic acid component or its anhydride or its lower alkyl ester, such as fumaric acid, maleic acid, maleic anhydride, phthalic acid, terephthalic acid, trimellitic acid, pyromellitic acid and mixtures thereof.

Figure 2:
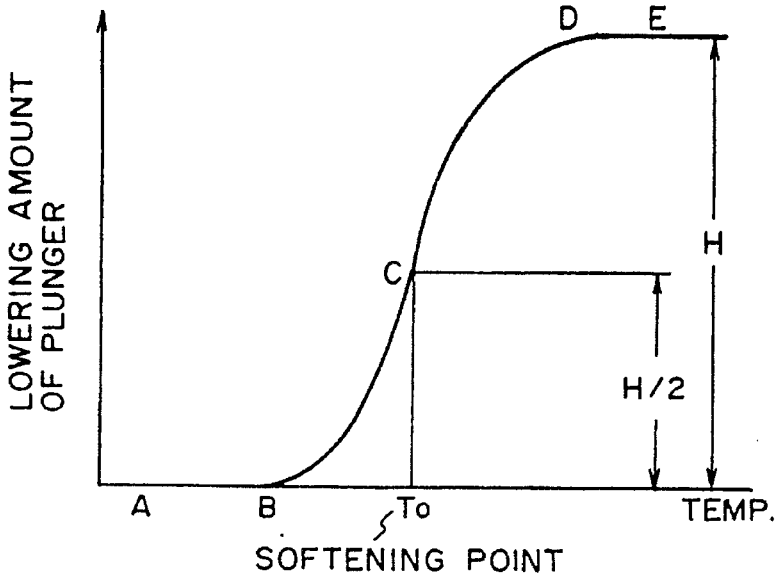
FIG. 2 is a graph showing a property of the toner used in the embodiment of FIG. 1.

The softening point of the polyester resin is 75°–150° C., preferably 80°–120° C. FIG. 2 shows the softening characteristics of the toner containing the polyester resin as the binder resin. The measuring method of the softening point in this embodiment will be described.

A flow tester CFT-500A, available from Simazu Seisakusho, is used which has a die (nozzle) having a diameter of 0.2 mm and a thickness of 1.0 mm with the pressing load of 20 Kg. The initial temperature is set at 70° C., and the preliminary heating period was 300 sec. After preliminary heating, the temperature is increased at a constant speed of 6° C./min. Then, the amounts of the plunger lowering are plotted relative to the temperature on the lowering amount vs. temperature curve (softening S curve). The weight of the toner is 1–3 g (precisely weighted) and the sectional area of the plunger is 1.0 $cm^2$. The softening S curve is as shown in FIG. 2. With a constant speed temperature increase, the toner is gradually heated, and it starts to flow (A-B). With further increase of the temperature, the fused toner flows out further (B-C-D) until the plunger lowering stops (D-E).

The height H of the S curve represents the total amount that flows out, and the temperature T0 corresponding to the point C(H)/2 is the softening point of the material (toner or resin).

Whether the toner and the binder resin have a sharp melt characteristics or not, can be determined on the measurement of the apparent fusing viscosity of the toner or the resin.

In this embodiment, a toner or binder resin having sharp melting characteristics means a toner satisfying the followings:

$$T1=90°–150°\ C.$$

$$|\Delta T|=|T1-T2|=5°–20°\ C.$$

where T1 is the temperature at which the apparent fusing viscosity is $10^3$ poise, and T2 is a temperature at which it shows $5\times10^2$ poise.

The sharp melting resin material having such temperature-viscosity characteristics is characterized by a sharp viscosity decrease when being heated. The viscosity decrease brings about proper mixing between the topmost toner layer and the bottommost toner layer, an abrupt increase of the transparency of the toner layers themselves, and therefore, the subtractive color mixture properly occurs.

The sharp melting color toner has strong affinity, and therefore, toner off-set tends to occur.

Figure 3:
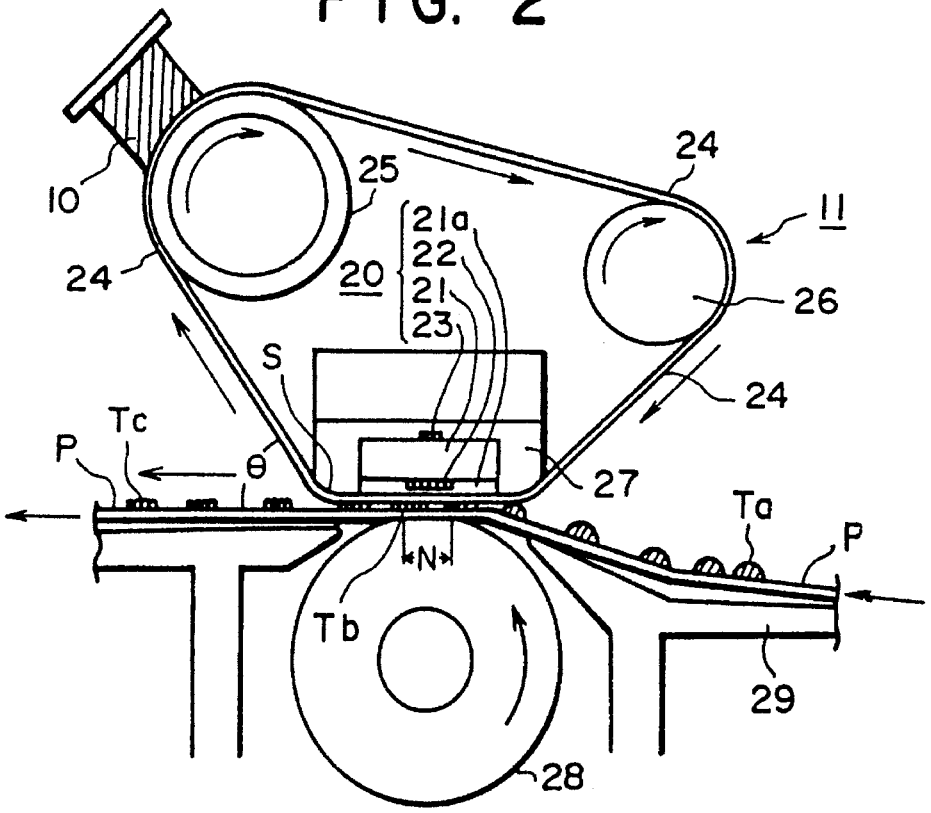
FIG. 3 is a sectional view of the heating and color-mixing apparatus according to the embodiment of FIG. 1.

FIG. 3 is an enlarged sectional view of a heating and color-mixing apparatus 11 for a color-mixing and fixing operation of multi-layer toner images, shown in FIG. 1. An endless fixing film 24 having a heat resistive layer is stretched around three parallel members, i.e., a driving roller 25 at the left side, a follower roller 26 at the right side and a low thermal capacity linear heater 20 disposed below and between the driving roller 25 and the follower roller 26.

The follower roller 26 also functions as a tension roller for the endless fixing film 24. When the driving roller 25 rotates in a clockwise direction, the fixing film 24 is rotated in the clockwise direction at a predetermined peripheral speed, that is, substantially at the same peripheral speed as the transfer sheet P having on its top face an unfixed toner image Ta supplied from an image forming station (not shown). In this embodiment, the peripheral speed is 50 mm/sec, and the endless film is rotated without any crease, snaking movement or delay.

A pressing roller 28 comprises a rubber elastic layer made of silicone rubber or the like having good parting properties. The pressing roller 28 is urged toward the bottom surface of the heater 20 with the bottom travel of the endless fixing film 24 therebetween, by an urging means (not shown) at a total pressure of 4–7 kg. It rotates in the same peripheral direction as the transfer material. The pressing roller 28 in this embodiment has a silicone rubber layer having an outer diameter of 30 mm and a thickness of 7 mm concentric with the core metal.

The heater 20 is a low thermal capacity linear heater extending in a direction crossing with the direction of the surface movement of the fixing film 24. It comprises a heater base 21, a heat generating resistor (heat generating element) 22, a temperature detecting sensor 23 or the like. It is fixed on a heater support 27.

The heater support 27 functions to insulate and support the heater 20 from the fixing device 11 and from the image forming apparatus incorporating the fixing device. The heater support 27 is made of highly heat resistive resin such as PPS (polyphenylene sulfide), PAI (polyamide imide), PI (polyimide), PEEK (polyether ether ketone), liquid crystal polymer or the like or a compound material of such a resin material and ceramics, metallic, glass or the like material.

The heater base 21 is made of heat resistive, electrically insulative, low thermal capacity and high conductivity material. As an example, it is an alumina plate having a thickness of 1 mm, a width of 10 mm and a length of 310 mm.

The heat generating element 22 is of Ag/Pd (silver-palladium), $Ta_2N$, $RuO_2$ or another electric resistor material and is applied by screen printing or the like along a length of the bottom surface of the heater base 21 (the surface opposed to the film 24) substantially along the center of the side with a thickness of approximately 10 microns, and a width of 1–3 mm. The electric resistance material is coated with a surface protection layer 21*a* of a heat resistive glass or PTFE or another heat resistive resin material in the thickness of approximately 10 microns.

An example of the temperature detecting element 23 is a low thermal capacity temperature sensor including Pt film or the like applied by screen printing or the like substantially at a center of the top surface of the base 21 (the surface opposite from the surface having the heat generating element 22). Another example of the temperature detecting element is a low thermal capacity thermister contacted to the base 21.

In the heater 20 of this embodiment, the heat generating element 22 in the form of a line or stripe is connected with and electric power source at the longitudinally opposite ends thereof to generate heat along the entire length of the heat generating element 22. The power source is AC 100 V, and the phase angle supplied to the heat generating element is controlled by an power supply control circuit (not shown) including a triac responsive to the output of the temperature detecting element 23, so that a fixing temperature of 180° C. is provided.

The film 24 used in this embodiment will be described. In order to permit a quick start by the small thermal capacity, the fixing film 24 has a total thickness of not more than 100 microns, preferably not more than 40 microns, and it may be a single layer or a multi-layer film having a heat resistivity, parting property, durability and the like.

Figure 4:
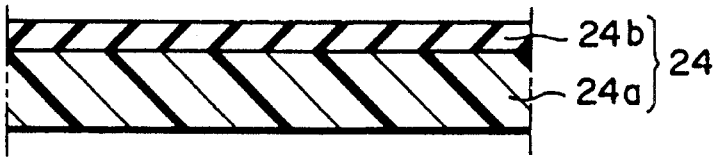
FIG. 4 is a sectional view of a film used in the embodiment of FIG. 1.

FIG. 4 is a sectional view of an example of a multi-layer film to show the laminated structure. In this example, it comprises two layers, i.e., a heat resistive base layer 24*a* and a parting layer (surface layer) on the outer surface of the heat resistive base layer 24*a*, that is, the surface faced to the toner image.

The heat resistive base layer 24*a* is made of a high heat resistive resin such as polyimide, polyether ether ketone (PEEK), polyether sulfone (PES), polyether imide (PEI), or polyparabanic acid (PPA).

Among these materials, the polyimide is preferable because it has excellent heat resistivity and strength properties.

The parting layer 24*b* has a thickness smaller than that of the base layer 24*a*, and an example of the material thereof includes a silicone rubber which is soft and which has a hardness smaller than that of the heat resistive base layer. Thus, the strength of the film is provided by the heat resistive base layer made of high hardness resin, and therefore, the film is not easily elongated or torn. On the contrary, the surface of the film adjacent the toner image is made of soft silicone rubber, and therefore the film contacts the laminated toner images as if it wraps the toner images, and the colors of the toners are properly mixed. Additionally, the deterioration of the image resolution attributable to expansion of the image can be prevented.

The surface of the parting layer 12 is easily triboelectrically charged. The surface resistance of the parting layer 24*b* is preferably not more than $10^{10}$ ohm. The resistance of the surface may be lowered by dispersing therein carbon black, graphite, conductive whisker material or another electrically conductive material. By doing so, the electric charging of the toner contactable surface of the fixing film 24 can be effectively prevented. When the toner contactable surface of the fixing film 24 is insulative, the surface of the fixing film is electrically charged with the result of a disturbance of the toner image on the sheet P and/or toner off-set (charge off-set) of the toner image to the fixing film 24. The above described low resistance surface can avoid such problems.

The film 24 may be made of a single layer of silicone rubber, but sufficient mechanical strength may not be provided if the thickness is small. Therefore, it is preferable that the film is of a multi-layer structure including a heat resistive base layer of a high tensile strength resin.

In the case of fixing color images, it is generally required that the fixed images have good color reproducibility and sufficiently high glossiness. For high glossiness, the film heating type fixing device is advantageous. More particularly, by reducing the surface roughness of the fixing film 24 on such a surface as is contactable to the toner image of the recording material, a high glossiness is provided. On the contrary, it is possible to provide less glossy images by roughening the surface of the fixing film 24.

Various surface roughnesses can be provided by blast treatment or the like after the production of the fixing film. In order to make the surface smooth, the fixing film may be produced using a mold having a specular inside surface which is known, thus providing a highly smooth fixing film surface. However, the method is not limited to this.

Description now will be made as to the color-mixing and image-fixing operation. When a copy button (not shown) is depressed, an image formation start signal is produced, and the image forming operation is started. On the transfer sheet P, yellow toner, magenta toner, and cyan toner are laminated into an unfixed toner image.

The sheet P supporting the unfixed toner image is fed to the heating and color-mixing apparatus 11. The sheet P is guided along the guide 29 and introduced into the nip N between the fixing film and the pressing roller 28, and the toner image carrying surface of the sheet P is passed through the nip N and is moved together with the fixing film 24 in contact with the bottom surface of the fixing film 24 which is rotating at the same peripheral speed as the conveying speed of the sheet P, without deviation or crease.

At a predetermined timing from the image formation start signal, the power supply to the heater 20 is started, so that the temperature of the heater increases. Before the sheet P enters the nip, the temperature of the heater 20 reaches a predetermined level, and is subjected to a constant temperature control operation.

The toner image Ta is heated by the nip N into a softened or fused image Tb. The fixing film 24 deflects at an acute angle (deflecting angle θ is approximately 45 degrees) by a large curvature edge S (the radius of curvature is approximately 22) of the heating support 27. Therefore, the sheet P passed through the nip N in overlapped relation with the fixing film 24 is separated from the fixing film 24 at the edge S by the curvature. As will be described hereinafter, at the time of the separation, the toner does not off-set even in the case of a full-color toner image, because the parting layer 24*a* of the fixing film 24 at the toner contactable side of the fixing film 24 is made of silicone rubber.

The sheet P separated from the fixing film 24 is discharged to a sheet discharge tray. Until the sheet is discharged, the toner is sufficiently cooled or solidified so as to be completely fixed on the sheet P as a toner image Tc.

In this example, the thermal capacities of the heat generating element 22 and the substrate 21 of the heater 20 are small, and they are supported on the support 27 through thermal insulation. Therefore, the surface temperature of the heater 20 in the nip N quickly reaches a sufficiently high temperature relative to the toner fusing point or the fixable temperature to the sheet P. Therefore, it is not necessary to increase the temperature of the heater 20 beforehand (what is called stand-by temperature control). Thus, energy consumption can be saved, and the inside temperature rise of the apparatus can be prevented.

Figure 5:
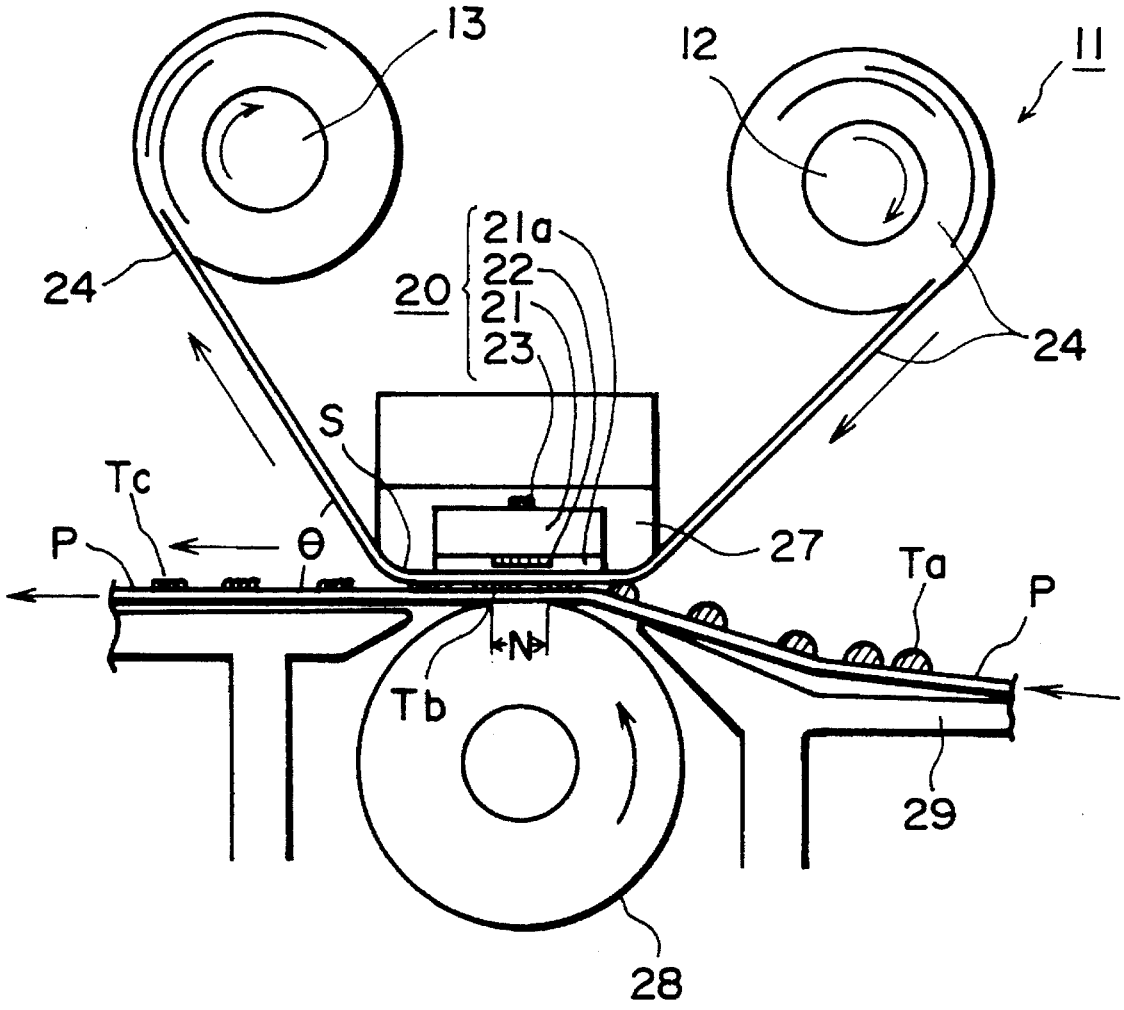
FIGS. 5–7 are sectional views of heating and color-mixing apparatuses according to further embodiments of the present invention.

FIG. 5 shows a heating and color-mixing apparatus according to another embodiment of the present invention. The fixing film 24 is not limited to an endless belt type. As shown in FIG. 5, it may be in the form of a non-endless film. An end thereof is rolled on a supply shaft 12 and is extended between the heater 20 and the pressing roller 28 and is rolled on a take-up shaft 13 at the other end. The film may be moved from the supply shaft 12 side to the take-up shaft side 13 at the same peripheral speed as the transfer sheet P (film take-up type).

Examples now will be explained.

Example 1

In the fixing apparatus 11 of FIG. 3, an image fixing film 24 in the form of an endless belt had the following heat resistive layer (base layer or base film) 24*a* and a parting layer (surface layer) 24*b*, in the form of a multi-layer (two layer) film.

Heat resistive layer 24*a*: polyimide film having a thickness of 20 microns.

Parting layer 24*b*: RTV (room temperature vulcanized type) silicone rubber layer having a thickness of 10 microns.

The surface of the polyimide film 24*a* was roughened by blast treatment or the like, an RTV silicone rubber primer was sprayed thereon, and then the RTV silicone rubber was sprayed thereon.

The image fixing apparatus 11 was incorporated in the image forming apparatus of FIG. 4, and a full-color image fixing operation was carried out. It was confirmed that satisfactorily color-mixed images were fixed without toner off-set to the fixing film.

Comparison Example

The parting layer 24*b* of the fixing film 24 was in the form of a PTFE or PFA coating (high hardness resin material), and a full-color image was fixed. Observed toner off-set was unsatisfactory for practical application.

Example 2

A fixing film 24 in the form of an endless belt had two layers as follows:

Heat resistive layer 24*a*: polyimide film having a thickness of 20 microns;

Parting layer 24*b*: LTV (low temperature vulcanized type) silicone rubber layer having a thickness of 10 microns.

As shown in FIG. 3, the surface of the parting layer 24*b* is contacted with a felt pad 10 (Normex, trade name, or the like) impregnated with silicone oil (dimethylsilicone oil, 10,000 CS). By doing so, a high parting property could be provided by the provision of a parting layer 24*b* of LTV silicone rubber and by the application of a silicone oil applied by the pad 10. The felt pad 10 may be in the form of a roller or web impregnated with silicone oil.

Such a fixing film 24 was incorporated in the fixing apparatus and the image forming apparatus, and full-color images were fixed. Satisfactory color-mixing and fixing operation without toner off-set to the fixing film was confirmed.

Example 3

In the image fixing apparatus 11 of FIG. 3, an endless fixing film 24 was in the form of a single layer film of single-liquid RTV silicone rubber having a thickness of 40 microns. The strength of the film was enhanced by adding known filler materials.

In the full-color image fixing operation of the apparatus using such a film, satisfactory color-fixing and fixing operations were confirmed without toner-off-set to the fixing film.

Example 4

The same film and the fixing apparatus as in Example 2 were used. However, the recording material P used was a transparent film (OHP film) for an overhead projector, and color images were fixed thereon.

In the case of OHP sheet fixing, transparency of the toner is desired, and therefore, the fixing speed is lowered to one half the speed in the case of paper, that is, lowered to 25 mm/sec in this example. In this case, the amount of heat applied by the heating nip N is doubled, and therefore, the toner is more softened, and the toner is still softened at the position of the edge S. However, in this example, the film has a high parting property, toner off-set is not produced with the aid of the application of the oil. Therefore, highly transparent images can be fixed on the OHP sheet.

Even when a slight amount of toner off-set occurs due to ambient condition variations, the off-set toner can be removed by the oil application means 10. A cleaning means for removing such toner may be provided in addition to the oil application means.

Figure 6:
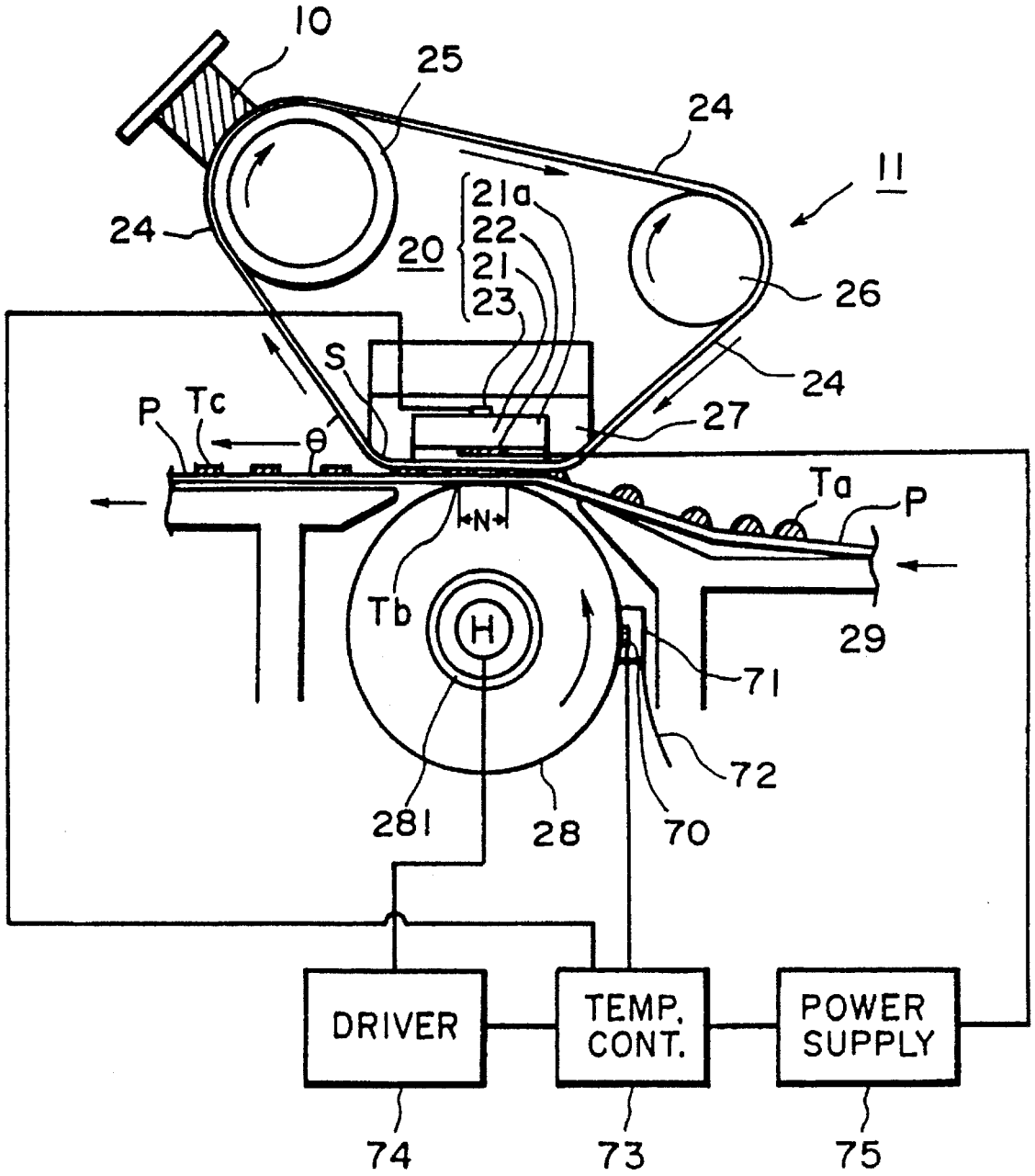

FIG. 6 shows a heating and color-mixing apparatus according to another embodiment of the present invention. In this embodiment, the heating means is provided in the pressing rotatable member cooperating with the film to form the nip. More particularly, a halogen heater H is provided in the pressing roller 28. A thermister 70 is resiliently pressed on the surface of the pressing roller by an elastic rubber sponge 71 and a leaf spring 72.

During the image fixing operation, a temperature control circuit 73 on-off controls the power supply to the halogen heater H by a driving circuit 74 including triac or the like so that the thermister 70 detects a predetermined temperature.

The pressing roller 28 in this embodiment is in the form of a silicone rubber roller having an outer diameter of 30 mm concentrically on a core metal 281 and has a thickness of 3 mm. It was made integral with the core metal 281 by molding with a metal mold or the like.

The heater 20 of this embodiment includes a heat generating resistor 22 in the form of a line or stripe, and it is connected with the power source at the longitudinally opposite ends thereof so that heat is generated over substantially the entire length of the heat generating element 22. The power source provides AC 100 V. At least during the fixing operation, the temperature control circuit 73 controls the phase angle of the power supply with the aid of a power supply control circuit 75 including a triac, so that the temperature detecting element 23 detects a constant temperature. By doing so, a fixing temperature of 180° C. is provided.

Description now will be made as to the heating and color-mixing operation. In response to an image formation start signal, the image forming operation is started, and a transfer sheet P having an unfixed toner image (black toner image or full-color toner image) Ta on its top surface is discharged from an image forming station (not shown) to the image fixing device 11. The transfer sheet P is guided by a guide 29 and is introduced into a nip N formed between the fixing film 24 and the pressing roller 28. It is passed through the nip N between the heater 20 and the pressing roller 28 together with the fixing film 24 and in close contact with the bottom surface of the fixing film 24 which is rotated in the same peripheral direction and at the same speed as the sheet P, without any deviation or crease. The heater 20 and the pressing roller 28 are supplied with electric power at a predetermined timing from the image formation start signal, and therefore, the toner image Ta is softened or fused by the heat applied in the nip N, into a softened or fused image Tb.

The fixing film 24 is deflected at an acute angle (deflection angle θ is approximately 45 degrees) at a large curvature edge S (the radius of the curvature is approximately 2 mm) of the heater support 27. Therefore, the sheet P overlapped with the fixing film 24 and having passed through the nip N is separated from the fixing film 24 at the edge S by the large curvature. At the time of separation, even if the toner image Ta is a full-color toner image, the toner-off-set does not substantially occur because the parting layer 24*a* of the fixing film 24 in contact with the toner image is of silicone rubber.

The sheet P separated from the fixing film 24 is discharged to the sheet discharge tray 12. Prior to the sheet is discharged, the toner being sufficiently cooled and solidified into a fixed image (DC).

In this embodiment, the heat generating element 22 and the base 21 of the heater 20 have low thermal capacities, and they are supported on the support 27 through thermal insulation. Therefore, the surface temperature of the heater 20 in the nip N quickly reaches a sufficiently high temperature relative to the fusing point of the toner (or the fixable temperature to the sheet P). Therefore, it is not necessary to increase the temperature of the heater 20 beforehand (what is called stand-by temperature control). Therefore, energy consumption can be saved, and the inside temperature of the apparatus can be prevented from rising.

A cleaner-applicator 10 functions to clean the fixing film 24 and to apply silicone oil thereto.

The outer peripheral surface of the film is not contacted by a member such as thermister or separation pawl in the direction perpendicular to the transfer material conveying direction.

Therefore, even if the parting or releasing oil is applied in large amount, no non-uniformity results from the difference of the amount of the oil application.

The surface of the pressing roller is maintained at a constant temperature of 110° C.

Since the surface of the pressing roller in the nip is maintained at 110° C., the nip temperature is maintained constant even if the temperature of the fixing film is not controlled.

The temperature rise of the pressing roller 28 is slower than that of the heater 20. Therefore, in the printing operation immediately after the main switch is actuated, the entirety of the pressing roller is not sufficiently heated. However, before the recording material enters the fixing nip, the pressing roller rotates so that the surface thereof is heated by the heater 20, and therefore, sufficient fixing performance can be provided.

During continuous printing in which temperature variation tends to occur, the surface temperature of the pressing roller is maintained constant, and therefore, constant temperature control of the heater 20 does not result in variation of the film surface temperature in the nip.

Figure 7:
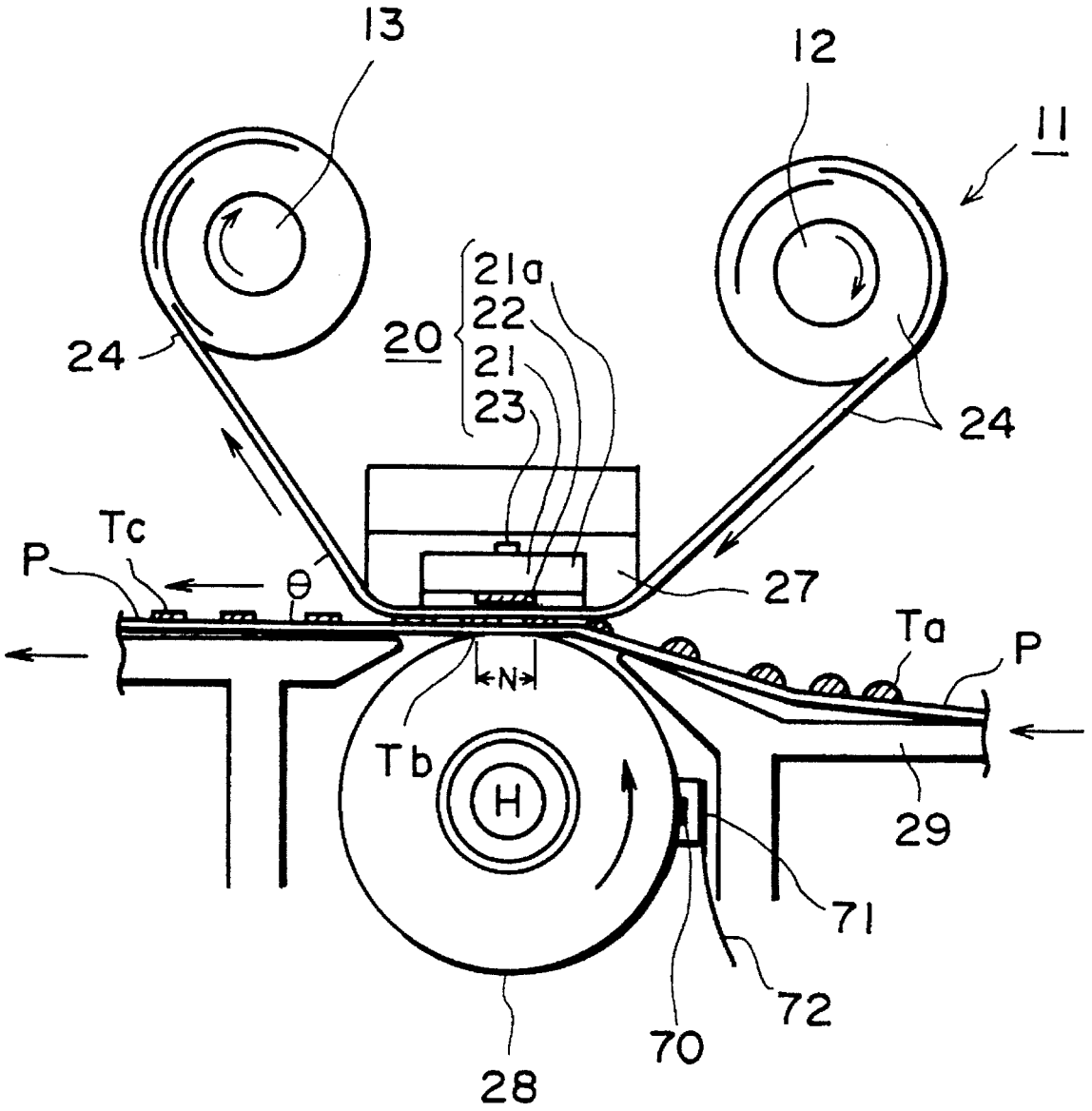

FIG. 7 is a sectional view of an image fixing apparatus according to a further embodiment of the present invention.

The fixing film 24 is not limited to the form of an endless belt, but may be a non-endless film, as shown in FIG. 3. The fixing film 24 in this embodiment is rolled on a supply shaft 12, and the other end is rolled on a take-up shaft 13. The fixing film is passed through a nip between the heater 20 and the pressing roller 28 in between. The fixing film is fed from the supply shaft 12 to the take-up shaft 13 at the same speed as the conveying speed of the transfer sheet P (film take-up type).

Now, description will be made by Examples.

Example 5

The apparatus used was as shown in FIG. 6. The pressing roller 28 comprised a core metal and HTV silicone rubber layer having a thickness of 3 mm and a hardness of JIS A hardness 40 degrees. The silicone rubber layer was coated with a fluorine resin tube having a thickness of 50 microns. The outside diameter of the pressing roller 28 was 30 mm. A 300 W halogen heater was provided in the pressing roller, and the control operation was carried out so that the thermister 70 detected a temperature of 110° C.

The endless fixing film 24 had the following heat resistive layer (base layer or base film) 24*a* and parting layer (surface layer) 24*b* (two layer structure):

Heat resistive layer 24*a*: polyimide film having a thickness of 20 microns;

Parting layer 24*b*: RTV (room temperature vulcanized) silicone rubber layer having a thickness of 10 microns (the surface of the polyimide film 24*a* was roughened by blast treatment; a primer for the RTV silicone rubber was sprayed thereon; and the RTV silicone rubber was sprayed thereon).

The fixing apparatus 11 was incorporated in the image forming apparatus of FIG. 4, and full-color images were fixed. It was confirmed that satisfactory fixing operations were carried out without toner off-set to the fixing film.

Comparison Example 2

The same apparatus was used with the exception that the pressing roller is not provided with the halogen heater H, and the full-color images were fixed.

The glossiness of the images was lost after approximately the 30th sheet in the continuous operation, and a cold off-set occurred so that the toner was separated from the transfer material.

This is because although the heater temperature was maintained at 180° C., the temperature of the pressing roller decreased with the continuous sheet processing, with the result that the heat amount applied to the toner in the nip was lowered.

Example 6

Black toner was used in the fixing apparatus having the structure of FIG. 6, and the parting layer 24*b* had PFA coating on its surface. The film were coated at its surface with PFA, and pressing roller had an outer diameter of 28 mm and a rubber thickness of 3 mm. A 100 W halogen heater was contained therein, so that the surface temperature thereof was controlled at 110° C.

Monochromatic unfixed images was continuously fixed, and it was confirmed that the good fixing operations were carried out for line images and solid black images.

Comparison Example 3

A 400 W heater was set in the pressing roller, and heating was carried out at all times during the fixing operation. After the 50th sheets in a continuous operation, hot toner off-set occurred. This is because the temperature of the pressing roller rises so that the toner receives a very large amount of heat despite the heater being maintained at a constant temperature.

Example 7

Example 5 was modified by using an endless fixing film 24 having the following two layers:

Heat resistive layer 24*a*: polyimide film having a thickness of 20 microns;

Parting layer 24*b*: LTV (low temperature vulcanized type) silicone rubber layer having a thickness of 50 microns.

As shown in FIG. 6, the surface of the parting layer 24*b* was contacted by a felt pad 10 (Normex, trade name, or the like) impregnated with silicone oil (dimethylsilicone oil, 10,000 cs). By doing so, high parting or releasing properties can be provided by the parting layer 24*b* of the LTV silicone rubber and the silicone oil (parting agent) applied by the pad 10. The parting agent applying mechanism 10 may be in the form of a roller or web impregnated with or coated with silicone oil.

The pressing roller had an outer diameter of 30 mm and a rubber thickness of 2 mm. A halogen heater of 200 W was contained therein. The pressing roller was maintained at 100° C. by the halogen heater.

In the case of the fixing apparatus, satisfactory fixing operations were carried out without toner off-set to the fixing film in the color image fixing operations.

Example 8

In the fixing apparatus 11 of FIG. 6, the endless fixing film 24 was a single-liquid RTV silicone rubber film having a thickness of 120 microns. The strength of the film was enhanced by known filler materials.

It was confirmed that satisfactory image fixing operations were carried out without toner off-set to the fixing film in the color image fixing operations.

Example 9

The image fixing apparatus of Example 6 was used, and the recording material P was a transparent film (OHP film) for an overhead projector. A color image was formed thereon, and the color image was fixed.

In the fixing operation on the OHP sheet, a toner transparency is required, and the fixing speed is lowered to one half the fixing speed for the sheet of paper, that is, lowered to 25 mm/sec. Since the amount of heat applied in the heating nip N is doubled, the degree of softening of the toner is increased. This results in that the toner is still softened at the edge S, but since in this example the highly parting nature fixing film is used, since the heat is applied properly by the pressing roller, and also since the parting oil is applied, highly transparent images can be fixed on the OHP sheet without toner off-set.

Depending on the transfer materials (thin sheet or the like), the heating and cooling conditions vary with the possible result that the toner is not completely cooled, so that toner off-set to the fixing film occurs. However, according to the embodiments of the present invention, this can be avoided.

Since the pressing roller contains therein a heater, the thickness and the material of the rubber is preferably highly heat resistive, and the thickness is preferably small, more particularly, not more than 3 mm.

While the invention has been described with reference to the structures disclosed herein, it is not confined to the details set forth and this application is intended to cover such modifications or changes as may come within the purposes of the improvements or the scope of the following claims.

What is claimed is:

1. A heating and color-mixing apparatus, comprising:

a heater;

a film disposed adjacent to said heater and slidably movable relative thereto together with a recording material supporting a multi-layer unfixed toner image; and a pressing member cooperative with said film to form a nip therebetween;

wherein the recording material is passed through the nip with said toner image contacted to said film, so that different color toners of the toner image are mixed by heat from said heater and pressure applied by the nip, wherein a sliding surface of said film is formed of a layer of heat resistive resin, wherein at least a recording material side of said film is composed of a layer of silicone rubber, and wherein said silicone rubber layer is thinner than said heat resistive resin layer.

2. An apparatus according to claim 1, wherein said sliding surface of said film is slidable on said heater and the layer of silicone rubber is formed on the layer of heat resistive resin.

3. An apparatus according to claim 1, wherein the resistive resin is polyimide resin.

4. An apparatus according to claim 1, further comprising means for applying silicone oil to a surface of the silicone rubber layer.

5. An apparatus according to claim 1, wherein the unfixed toner image comprises yellow toner, magenta toner and cyan toner, and a full-color image is formed by mixing the toners.

6. An apparatus according to claim 1, wherein said silicone rubber is RTV silicone rubber.

7. A heating and color-mixing apparatus, comprising:

a heater;

a film having a first surface in slidable contact with said heater and a second surface movable together with and in contact with an unfixed toner image including layers of different color toners on a recording material;

a pressing roller cooperable with said heater to form a nip with said film interposed therebetween, wherein the unfixed toner image is subject to heat and pressure in said nip, so that the different color toners are mixed;

temperature detecting means disposed on said pressing roller for detecting a temperature of said pressing roller indicative of the temperature of said film in the nip, without contacting said film; and control means, responsive to an output of said temperature detecting means, for controlling said heater so that a temperature detected by said temperature detecting means is maintained at a predetermined temperature at least when the different color toners are mixed.

8. An apparatus according to claim 7, wherein the unfixed toner image comprises yellow toner, magenta toner and cyan toner, and a full-color image is formed by mixing the toners.

9. An apparatus according to claim 7, wherein said heater is stationary in use, and said film slides on said heater.

10. An apparatus according to claim 9, wherein the recording material is conveyed with its toner image carrying side near said film, and wherein at least a recording material side of said film is composed of silicone rubber.

11. An apparatus according to claim 10, wherein a surface of said film slidable on said heater is composed of a layer of heat resistive resin, on which a layer of silicone rubber is formed.

12. An apparatus according to claim 11, wherein the heat resistive resin is polyimide resin.

13. An apparatus according to claim 11, wherein said silicone rubber layer is thinner than said heat resistive resin layer.

14. An apparatus according to claim 11, further comprising means for applying silicone oil to a surface of the silicone rubber layer.

15. A heating and color-mixing apparatus, comprising:

a heater;

a film disposed adjacent to said heater and slidably movable relative thereto together with a recording material carrying a multi-layer unfixed toner image; and a pressing member cooperative with said film to form a nip therebetween, wherein the recording material is fed with a toner image carrying side near said film, and different color toners of the toner image are mixed by heat from said heater and pressure by the nip, wherein said film has a resin base layer and a surface rubber layer contactable to the toner image, said surface rubber layer having a hardness lower than that of said base layer, and wherein said surface rubber layer is formed on said resin base layer and has a thickness smaller than that of said base layer.

16. An apparatus according to claim 15, wherein said base layer slides on said heater.

17. An apparatus according to claim 16, wherein said base layer is composed of polyimide resin.

18. An apparatus according to claim 15, wherein said surface rubber layer is composed of silicone rubber.

* * * * *

UNITED STATES PATENT AND TRADEMARK OFFICE

CERTIFICATE OF CORRECTION

PATENT NO. : 5,499,088

DATED : March 12, 1996

INVENTOR(S) : TAKESHI MENJO

It is certified that error appears in the above-indentified patent and that said Letters Patent is hereby corrected as shown below:

ON THE TITLE PAGE:

At item [56] References Cited;

Insert --60-263173 12/1985 Japan 355/285--.

Column 2

Line 54, "an" should read --a--.

Column 3

Line 25, "drum 1" should read --drum 31--.
Line 27, "drum 1." should read --drum 31.--.
Line 60, "color-reproduceable" should read --color-reproducible--.
Line 67, "toner powdery" should read --powdery toner--.

Column 4

Line 55, "sharp" should read --a sharp--.
Line 57, "ings:" should read --ing:--.

Column 5

Line 5, "the" should read --a--.
Line 48, "like" should read --like,--.
Line 49, "ceramics," should read --a ceramic,--.
Line 50, "heat" should read --a heat--.

UNITED STATES PATENT AND TRADEMARK OFFICE

CERTIFICATE OF CORRECTION

PATENT NO. : 5,499,088

DATED : March 12, 1996

INVENTOR(S) : TAKESHI MENJO

It is certified that error appears in the above-indentified patent and that said Letters Patent is hereby corrected as shown below:

Column 6

Line 7, "and" should read --an--.
Line 11, "an" should read --a--.
Line 47, delete "12".

Column 7

Line 38, "22)" should read --2mm)--.

Column 8

Line 67, "toner-off-set" should read --toner off-set--.

Column 9

Line 13, "toner" should read --and toner--.

Column 10

Line 9, "toner-off-set" should read --toner off-set--.
Line 15, "is" should read --being--.
Line 16, "being" should read --is--.

UNITED STATES PATENT AND TRADEMARK OFFICE

CERTIFICATE OF CORRECTION

PATENT NO. : 5,499,088 Page 3 of 3

DATED : March 12, 1996

INVENTOR(S) : TAKESHI MENJO

It is certified that error appears in the above-indentified patent and that said Letters Patent is hereby corrected as shown below:

Column 11

Line 52, "were" should read --was--.
Line 58, "the" should be deleted.
Line 65, "sheets" should read --sheet--.

Signed and Sealed this

Third Day of September, 1996

Attest:

Bruce Lehman

BRUCE LEHMAN

Attesting Officer

Commissioner of Patents and Trademarks